US006776378B1

(12) United States Patent
Yu

(10) Patent No.: US 6,776,378 B1
(45) Date of Patent: Aug. 17, 2004

(54) WATER DISPENSER STAND WITH STORAGE ARRANGEMENT

(76) Inventor: Charles Y. Yu, 25603 Amberleaf Rd., Torrance, CA (US) 90505

( * ) Notice: Subject to any disclaimer, the term of this patent is extended or adjusted under 35 U.S.C. 154(b) by 0 days.

(21) Appl. No.: 10/390,319

(22) Filed: Mar. 18, 2003

(51) Int. Cl.[7] ..... A47B 73/00

(52) U.S. Cl. ..... 248/146; 248/176.1; 211/74; 211/85.18

(58) Field of Search ..... 211/74, 85.18, 211/194, 85.22; 248/146, 148, 149, 150, 151, 163.1, 165, 176.1; 210/473

(56) References Cited

U.S. PATENT DOCUMENTS

| | | | | | |
|---|---|---|---|---|---|
| 1,858,299 | A | * | 5/1932 | Korn | 294/143 |
| 4,064,993 | A | * | 12/1977 | Getner | 211/85 |
| 4,416,380 | A | * | 11/1983 | Flum | 211/59.2 |
| 5,370,245 | A | * | 12/1994 | Tersch et al. | 211/74 |
| 5,582,302 | A | * | 12/1996 | Kozak | 211/74 |
| 6,290,074 | B1 | * | 9/2001 | Syvuk et al. | 211/74 |
| 6,578,802 | B1 | * | 6/2003 | Thier | 248/151 |

OTHER PUBLICATIONS

XSports Website, www.xsports.com/water.html, Jan. 31, 1997.*

U.S. patent application Publication No. US 2003/0071179, filed Oct. 11, 2001, published Apr. 17, 2003, inventor: Mearns.*

* cited by examiner

*Primary Examiner*—Leslie A. Braun
*Assistant Examiner*—Jon Szumny
(74) *Attorney, Agent, or Firm*—Raymond Y. Chan; David and Raymond Patent Group

(57) ABSTRACT

A water dispenser stand includes a floor stan having a storage chamber and an opening communicating with the storage chamber and with the outside, a frame for supporting a water bottle on top of the floor stand, and a storage arrangement supported within the storage chamber of the floor stand, wherein the storage arrangement includes a front holding bracket having an arc-shaped positioned at the opening of the storage chamber for substantially retaining an upper portion of the water bottle when the water bottle is received in the storage chamber, a rear stopper arm spaced positioned below the holding bracket, and a guiding body inclinedly extended from the holding bracket to the stopper arm for guiding the water bottle to slide into the storage chamber until a bottom side of the water bottle is stopped at the stopper arm so as to inclinedly support the water bottle in the storage chamber.

5 Claims, 5 Drawing Sheets

WATER DISPENSER STAND WITH STORAGE ARRANGEMENT

BACKGROUND OF THE PRESENT INVENTION

1. Field of Invention

The present invention relates to a water dispenser, and more particularly to a water dispenser stand with a storage arrangement which is capable of securely storing a water bottle within a storage chamber of the water dispenser stand.

2. Description of Related Arts

Many householders prefer to use drinking water from a bottle because it is from a known source. This is wise in many countries foreign to the United States, and many persons carry this cultural preference with them when they come to the United States. Others prefer the flavor of bottled water or require water which is low in sodium or other minerals.

For these and related reasons, bottled water is commonly available in the United States. It is purchased or delivered in large bottles, such as 3-gallon and 5-gallon bottles. Such bottles are difficult to use when it is desired that only a small amount of water be dispensed. Because of this, several dispensing structures are available. One of these dispensing structures is a ceramic jar with a valve and spout on the side thereof. When the jar is filled with water and the valve is opened, the spout issues waters. These ceramic jars are configured to carry one of the large water bottles inverted on the top thereof. Thus, the water bottle dispenses water to the jar, as required, and the jar dispenses water from its valve and spout.

Since deliveries of water bottles are intermittent and since it is desired that a continuous supply be available for dispensing out of the spout, it is common to have on hand extra water bottles. Usually, these extra water bottles stand on the floor adjacent the dispenser. However, in such a position, they are in the way. It is desirable to have a suitable nearby location in which to store extra bottles.

SUMMARY OF THE PRESENT INVENTION

In order to aid in the understanding of this invention, it can be stated in essentially summary form that it is directed to a water dispenser stand with storage arrangement. The stand has a floor stand and a stand top supported by the floor stand. The stand top is configured for carrying thereon a ceramic water jar. Within the floor stand, there is at least one bottle support configured to hold a water bottle which is not presently in use.

A main object of the present invention is to provide a water dispenser stand with storage arrangement for extra water bottles which are not presently in use dispensing water.

Another object of the present invention is to provide a water dispenser stand with storage arrangement, wherein the water bottle is substantially supported within a storage chamber of the floor stand in an inclination manner, so as to stably store the water bottle.

Another object of the present invention is to provide a water dispenser stand with storage arrangement which is configured to receive a ceramic water dispensing jar on its top with the jar being configured to receive an inverted water bottle so that the jar dispenses water, together with storage in the ground stand for one or more bottles not presently in use.

Another object of the present invention is to provide a water dispenser stand with storage arrangement wherein more than one water bottle can be substantially supported by the water dispenser stand along a longitudinal direction thereof so as to maximize the number of bottles which can be stored, and minimize extra transverse occupation of space by each additional water bottle.

Another object of the present invention is to provide a water dispenser stand with storage arrangement which is configured so that it can be easily assembled so that it can be shipped in a compact configuration and assembled when needed.

Another object of the present invention is to provide a water dispenser stand with storage arrangement which does not involve complicated mechanical process and equipments, and does not significantly alter the original structure of the water dispenser stand and the water dispenser mounted thereabove, so as to minimize the manufacturing and other related cost in producing the water dispenser stand of the present invention.

Another object of the present invention is to provide a water dispenser stand with storage arrangement which substantially support a predetermined amount of water bottles at a position below the water dispenser so that the general stability of the water dispenser will not be substantially affected. Furthermore, the distance between the water dispenser and the position where the water bottles are stored can also be minimized. In other words, the distance by which a water bottle is to be transported from the storing position to the water dispenser is minimized.

Another object of the present invention is to provide a water dispenser with storage arrangement, which is ornamental so that its appearance at the water dispensing location is not objectionable.

Another object of the present invention is to provide a water dispenser which comprises a water dispenser stand with storage arrangement which is capable of allowing a predetermined amount of water bottles for use by the water dispenser to be securely stored and substantially supported by the water dispenser leg of the present invention.

In order to accomplish the above objects, the present invention provides a water dispenser stand, comprising:

- a floor stand having a storage chamber and an opening communicating with the storage chamber with outside;
- means for supporting a water bottle on top of the floor stand; and
- a storage arrangement, which is supported within the storage chamber of the floor stand, comprising:
- a front holding bracket having an arc-shaped positioned at the opening of the storage chamber for substantially retaining an upper portion of the water bottle when the water bottle is received in the storage chamber;
- a rear stopper arm spaced positioned below the holding bracket; and
- a guiding body inclinedly extended from the holding bracket to the stopper arm for guiding the water bottle to slide into the storage chamber until a bottom side of the water bottle is stopper at the stopper arm so as to inclinedly support the water bottle in the storage chamber.

These and other objectives, features, and advantages of the present invention will become apparent from the following detailed description, the accompanying drawings, and the appended claims.

DETAILED DESCRIPTION OF THE PREFERRED EMBODIMENT

Figure 1:
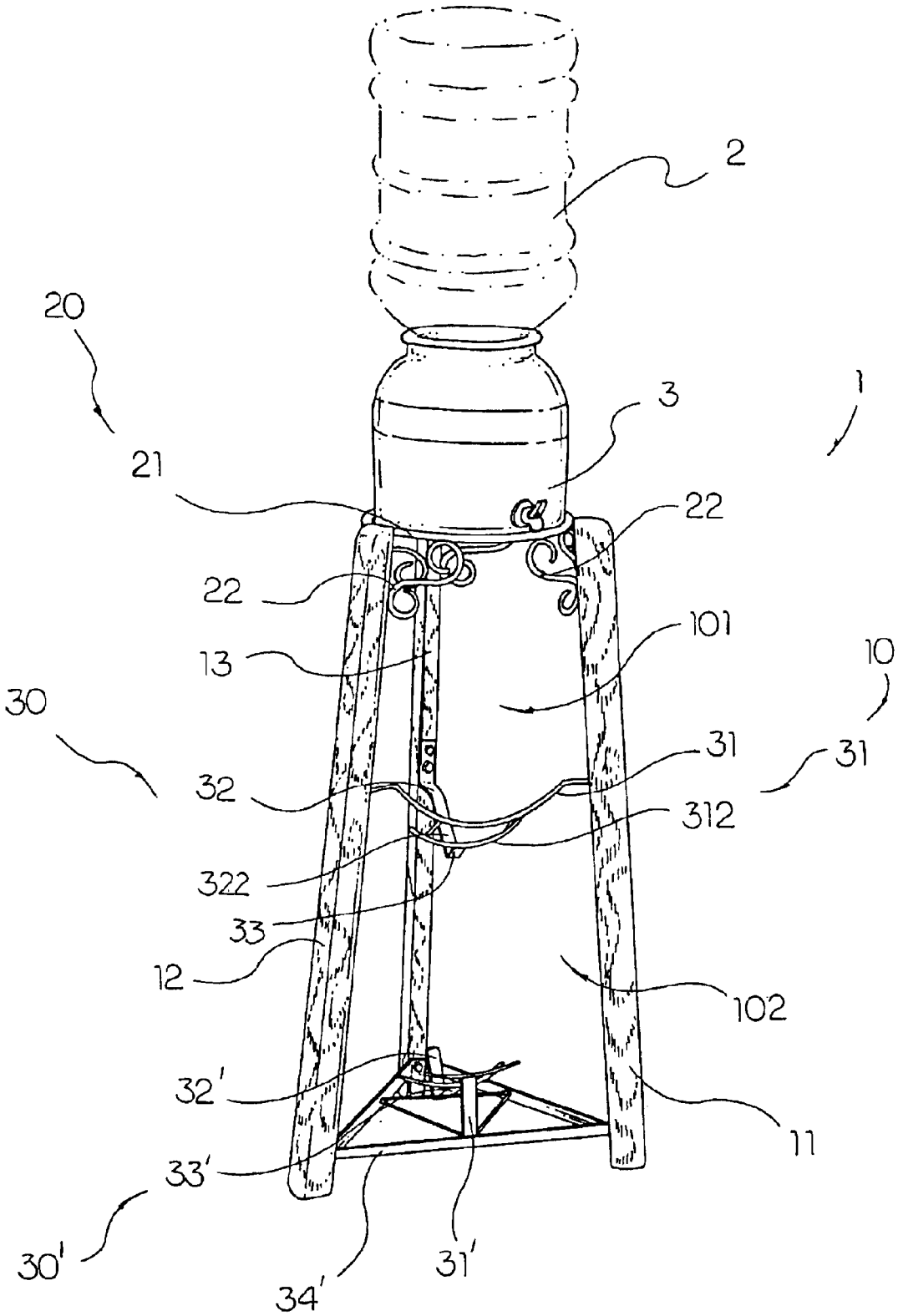
FIG. 1 is a perspective view of a water dispenser stand incorporated with a storage arrangement according to a first preferred embodiment of the present invention.

Referring to FIG. 1 of the drawings, a water dispenser stand 1 according to a first preferred embodiment of the present invention is illustrated. According to the preferred embodiment, the water dispenser stand 1 comprises a floor stand 10 having a storage chamber 101 and an opening 102 communicating with the storage chamber 101 with outside, and means 20 for supporting a water bottle 2 on top of the floor stand 10.

The water dispenser stand 1 further comprises a storage arrangement 30, which is supported within the storage chamber 101 of the floor stand 10, comprising a front holding bracket 31 having an arc-shaped supported at the opening 102 of the storage chamber 101 for substantially retaining an upper portion of the water bottle 2 when the water bottle 2 is received in the storage chamber 101, a rear stopper arm 32 spaced positioned below the holding bracket 31, and a guiding body 33 inclinedly extended from the holding bracket 31 to the stopper arm 32 for guiding the water bottle 2 to slide into the storage chamber 101 until a bottom side of the water bottle 2 is stopper at the stopper arm 32 so as to inclinedly support the water bottle 2 in the storage chamber 101.

According to the first embodiment, the floor stand 10 comprises first through third supporting legs 11, 12, 13 wherein the storage chamber 101 is defined within the first, second, and third supporting legs 11, 12, 13. The first through third legs 11, 12, 13 are inclinedly and downwardly extended so that the size of the storage chamber 101 is gradually reduced from the supporting mean 20 to the floor. In addition, the configuration of the floor stand 10 can rigidly support on the floor in a stabilization manner.

The supporting means 20 comprises a supporting platform 21 mounted on top of the first, second, and third supporting legs 11, 12, 13 of the floor stand 10, wherein the supporting platform 21 is sized for supporting a ceramic water jar 3 thereon in such a manner that the water bottle 2 is capable of invertly supporting on the water jar 3.

In order to further enhance the supporting strength of the floor stand 10, the supporting means 20 further comprises a plurality of braces 22 inclinedly extended between the supporting platform 21 and the upper supporting portions of the first through third supporting legs 11, 12, 13 respectively. According to the preferred embodiment of the present invention, each of the braces 22 is shaped to have an aesthetically sound appearance so that they have an additional function of decorating the floor stand 10 of the present invention.

The supporting platform 21 may be a metal ring with a floor in it, and the first, second, and third supporting legs 11, 12, 13 may be welded thereto. The first, second, and third supporting legs 11, 12, 13 may be strengthened by the braces, such as the functional and decorative brace 22. There is a corresponding functional and decorative brace for the bracket and there may also be one for the bracket. The supporting platform 21 is circular, and the first, second, and third supporting legs 11, 12, 13 are positioned 120 degrees apart around the circumference thereof.

According to the preferred embodiment, the two ends of the holding bracket 31 is fastened to the first and second supporting legs 11, 12 respectively and the rear stopper arm 32 is affixed to the third supporting leg 13 while the guiding body 33 is extended between the holding bracket 31 and the rear stopper arm 32.

The first, second, and third supporting legs 11, 12, 13 are wooden legs (or tubular metal legs) which can be assembled by screws such as machine screws and supported by the supporting means 20 on top and the storage arrangement 30 at the middle portion. The machine screws are shown with respect to the braces 22. They may have a head on the outside and be threaded through corresponding holes in the braces 22 or may have nuts thereon, preferably on the interior surface of the braces 30. Each of the first, second, and third supporting legs 11, 12, 13 is attached in the same way.

The attachment of the first, second, and third supporting legs 11, 12, 13 by such fasteners as machine screws or sheet metal screws permits assembly after shipping from the manufacturer by the ultimate user or by the retailer. This saves considerable volume in the shipping of the water dispenser stands 1. Another way of providing compact, shipping includes configuring the first, second, and third supporting legs 11, 12, 13 in two telescoping parts which may be disassembled during shipping and assembled into full length thereafter. Accordingly, each of the first, second, and third supporting legs 11, 12, 13 has an upper section and a lower section, which are joined at a telescopic joint. The lower section of each of the first, second, and third supporting legs 11, 12, 13 is a slightly reduced upper nose which fits into the lower end of the upper section of each of the corresponding first, second, and third supporting legs 11, 12, 13. Dividing the first, second, and third supporting legs 11, 12, 13 during shipment and joining them during assembly of the water dispenser stand 1 saves further shipping space.

Accordingly, the water jar 3 has a large top open mouth on which can be inverted the water bottle 2. The water bottle 2 is usually made of glass or polymer composition material and is usually of 2 to 5 gallons in size. The water in the water bottle 2 empties into the water jar 3 until the water level in the water jar 3 rises to the neck of the water bottle 2. If the user desires water, he or she dispenses it to himself or herself from water spout which is fitted to the side of the water jar 3 near its bottom side. The flow in the water spout is controlled by a valve.

It is worth mentioning that the supporting means 20 can be embodied as the water jar 3 directly supported on the floor stand 10 without the supporting platform 21. In other words, the first, second, and third supporting legs 11, 12, 13 are downwardly extended from the water jar 3 to support the water bottle 2 in an inverted manner.

Figure 3:
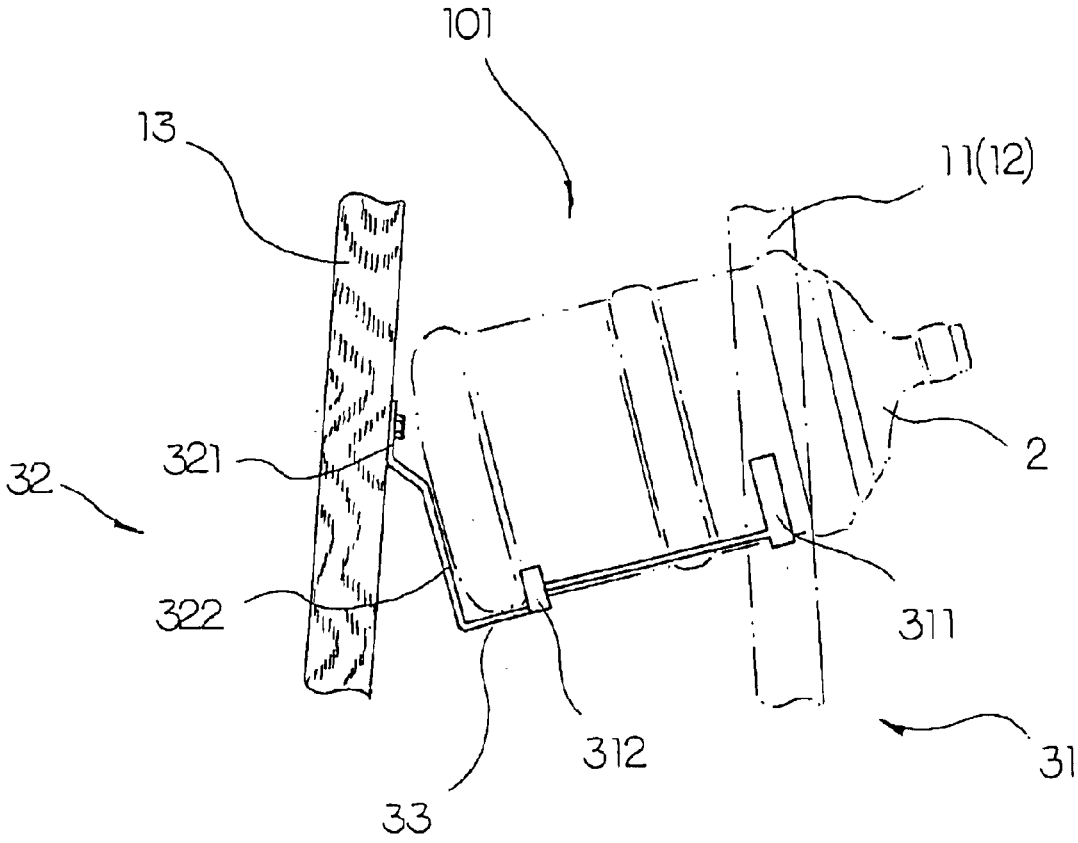
FIG. 3 is a front view of the storage arrangement of the water dispenser stand according to the above first preferred embodiment of the present invention.

According to the preferred embodiment, the holding bracket 31 has a curvature larger than a curvature of the water bottle 2, as shown in FIG. 3, in such a manner that when the water bottle 3 is inclinedly supported in the storage chamber 101, the holding bracket 31 is substantially retain the water bottle 2 in position, so as to prevent an unwanted lateral movement of the water bottle 2 in the storage chamber 101. In addition, when the water bottle 2 is slid into the storage chamber 101, the holding bracket 31 is adapted for guiding the water bottle 2 to slide along the guiding body 33 until the bottom side of the water bottle 2 is biased against the stopper arm 32.

Figure 2:
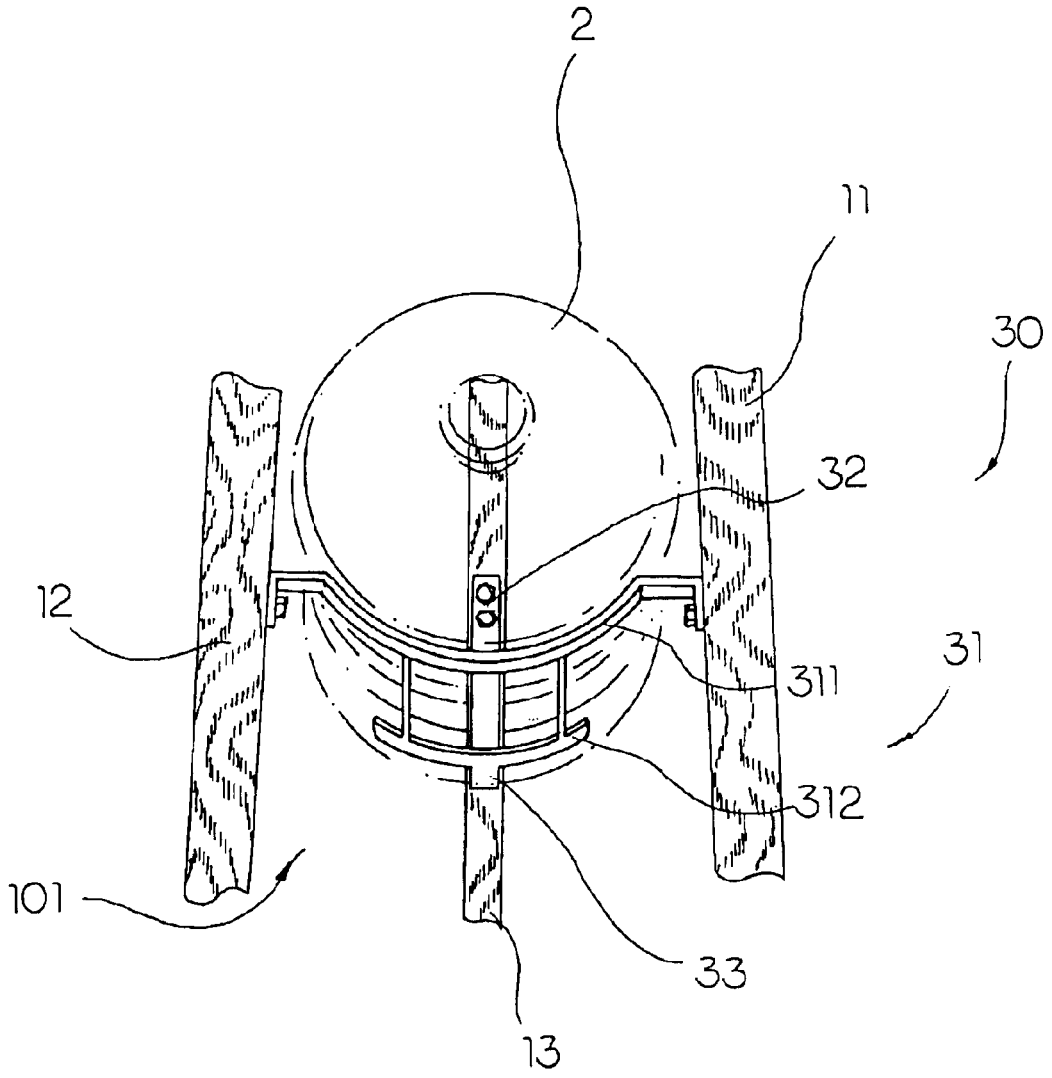
FIG. 2 is a side view of the storage arrangement of the water dispenser stand according to the above first preferred embodiment of the present invention.

As shown in FIGS. 1 and 2, the holding bracket 31 is transversely extended between the first and second supporting legs 11, 12 of the floor stand 10 so that the original structural design of the floor stand 10 does not require to be altered in order to incorporate with the holding bracket 31. Furthermore, the opening 102 of the storage chamber 101 is defined between the first and second supporting legs 11, 12 of the floor stand 10.

For enhancing the support of the holding bracket 31, the holding bracket 31 comprises a first yoke 311 mounted at the opening 102 of the storage chamber 101 and a second yoke 312 spaced apart from the first yoke 311 so as to substantially increase a supporting surface of the holding bracket 31 for supporting the water bottle 2.

The stopper arm 32 is substantially supported at a rear side of the storage chamber 101 at a position below the holding bracket 31, wherein a distance between the stopper arm 32 and the holding bracket 31 should be long enough that when the water bottle 2 is inclinedly received in the storage chamber 101, the center of mass of the water bottle 2 should be fall between the holding bracket 31 and the stopper arm 32. As shown in FIG. 3, the stopper arm 32 is mounted on the third supporting legs 13 in such a manner that when the water bottle 2 is inclinedly supported in the storage chamber 101, the weight of the water bottle 2 is substantially distributed to the first, second, and third supporting legs 11, 12, 13 of the floor stand 10, so as to prevent the distortion of the storage arrangement 30 while supporting the water bottle 2.

As shown in FIG. 3, the stopper arm 32 has a retaining portion 321 securely attached to the third supporting leg 13 of the floor stand 10 and a biasing portion 322 extended from the retaining portion 321 to the guiding body 33 for substantially biasing against the bottom side of the water bottle 2, wherein the biasing portion 322 of the stopper arm 32 is perpendicularly extended from the guiding body 33 to form a right angle (90 degrees) therebetween in such a manner that the biasing portion 322 of the stopper arm 32 is capable of substantially biasing against the bottom side of the water bottle 2 while the guiding body 33 is capable of rigidly supporting a circumferential side of the water bottle 2 thereon.

The guiding body 33 is integrally extended from the holding bracket 31 to the stopper arm 32 to form an integral member so as to enhance the strength of the storage arrangement 30. The inclination of the guiding body 33 is arranged to guide the water bottle 2 to slide from the holding bracket 31 towards the stopper arm 32 until the bottom side end of the water bottle 2 is biased against the stopper arm 32, so as to retain the water bottle 2 within the storage chamber 101 in an inclination manner, as shown in FIG. 2.

It is worth to mention that the inclination of the guiding body 33 further ensures the stabilization of the water bottle 2 and enhances the storing operation thereof. When the water bottle 2 is inclinedly slid into the storage chamber 101, the center of mass of the water bottle 2 is positioned between the holding bracket 31 and the stopper arm 32 so that the water bottle 2 is immovably stored in the storage chamber 101 so as to prevent the water bottle 2 sliding out of the storage chamber 101. In addition, due to the inclination of the guiding body 33, the water bottle 2 is automatically slid to rest on the guiding body 33. In other words, once the bottom side of the water bottle 2 is slidably supported on the holding bracket 31, the water bottle 2 is automatically slid into the storage chamber 101.

Since the water bottle 2 is inclinedly supported in the storage chamber 101 to minimize the occupying space required for storage, more than one water bottle 2 can be stored in the storage chamber 101. As shown in FIG. 1, the floor stand 10 incorporates with two storage arrangements 30 wherein one of the storage arrangements 30 is supported at an upper portion of the storage chamber 101 while another storage arrangement 30 is supported at a lower portion of the storage chamber 101. In other words, two water bottles 2 can be stored in the storage chamber 101. Accordingly, the size of the storage chamber 101 determines number of water bottles 2 can be stored therein.

In order to store the water bottle 2 in the storage chamber 101 of the floor stand 10, the user simply places the bottom side of the water bottle 2 on the holding bracket 31 at the opening 102 and pushes the water bottle 2 into the storage chamber 101 so that the water bottle 2 will automatically slide along the guiding body 33 until the bottom side of the water bottle 2 hits the stopper arm 32 so as to block up the further sliding movement of the water bottle 2 in the storage chamber 101. It is worth mentioning that when the water bottle 2 is supported in the storage chamber 101, the holding bracket 31 and the stopper arm 32 can restrict any transverse and sideward movements of the water bottle 2. Since the neck portion of the water bottle 2 is inclinedly positioned towards the opening 102 of the storage chamber 101, the user is able to easily pull out the water bottle 2 from the storage chamber 101 for use.

Figure 4:
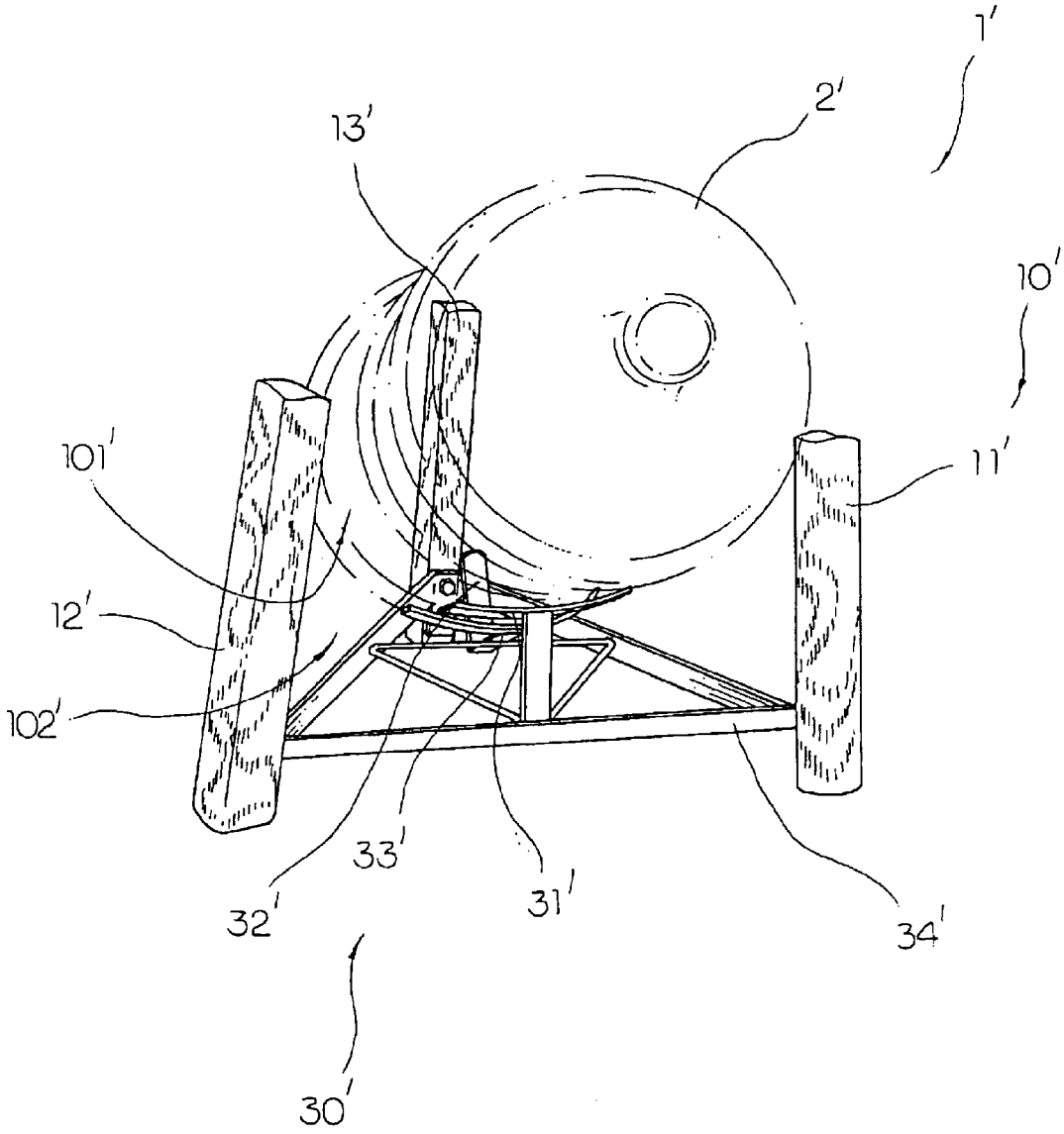
FIG. 4 is a side view of the storage arrangement of the water dispenser stand according to a second preferred embodiment of the present invention.
Figure 5:
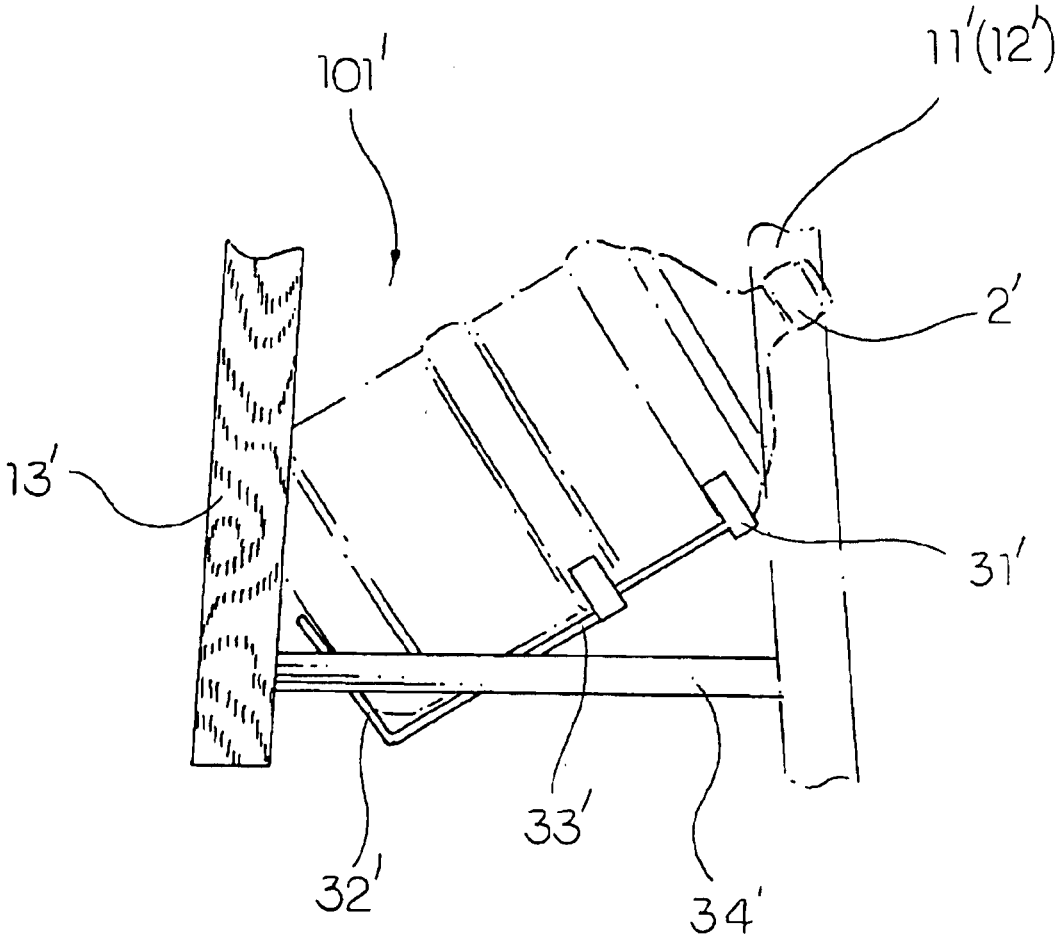
FIG. 5 is a front view of the storage arrangement of the water dispenser stand according to the above second preferred embodiment of the present invention.

Referring to FIGS. 4 and 5, a water dispenser stand 1' of a second embodiment illustrates an alternative mode of the first embodiment of the present invention, wherein the structural configurations of the floor stand 10' and the supporting means 20' are the same, such as the first, second, and third supporting legs 11', 12', 13', and the supporting platform 21', except the storage arrangement 30'.

According to the second embodiment, the storage arrangement 30' which is supported within the storage chamber 101' of the floor stand 10', comprises a front holding bracket 31' having an arc-shaped positioned at the opening 102' of the storage chamber 101', a rear stopper arm 32' spaced positioned below the holding bracket 31', and a guiding body 33' inclinedly extended from the holding bracket 31 to the stopper arm 32' for guiding the water bottle 2 ' to slide into the storage chamber 101' until a bottom side of the water bottle 2' is stopper at the stopper arm 32' so as to inclinedly support the water bottle 2' in the storage chamber 101'.

As shown in FIG. 4, the storage arrangement 30' further comprises a base frame 34' substantially supported in the storage chamber 101' wherein the holding bracket 31' is upwardly extended from the base frame 34' at the opening 102' of the storage chamber 101'. Accordingly, the base frame 34' is shaped to have a triangular shape having three comers substantially connected to the first, second, and third supporting legs 11', 12', 13' respectively. Therefore, the base frame 34' not only supports the holding bracket 31' but also reinforces the rigid configuration of the floor stand 10'.

The stopper arm 32' is substantially supported on the base frame 34' at a rear side of the storage chamber 101' at a position below the holding bracket 31' wherein the guiding body 33' is inclinedly extended from the holding bracket 31' to the stopper arm 32' to guide the sliding movement of the water bottle 2' into the storage chamber 101'.

Accordingly, the stopper arm 32' is integrally extended from the guiding body 33' in a perpendicular manner in such a manner that when the water bottle 2' is slid into the storage chamber 101', the stopper arm 32' is capable of biasing against the bottom side of the water bottle 2' while the holding bracket 31' supports the upper portion of the water bottle 2' so as to inclinedly hold the water bottle 2' in the storage chamber 101'.

It is worth to mention that since the holding bracket 31', the stopper arm 32', and the guiding body 33' are supported on the base frame 34', the storage arrangement 30' is capable of incorporating with any size and shape of the floor stand 10' by altering the size and shape of the base frame 34' to substantially fit into the storage chamber 101'.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A water dispenser stand, comprising:

a floor stand having a storage chamber and an opening communicating with said storage chamber and with the outside;

means for supporting a water bottle on top of said floor stand; and a storage arrangement, which is supported within said storage chamber of said floor stand, comprising:

a front holding bracket having an arc-shape and supported at said opening of said storage chamber for substantially retaining an upper portion of said water bottle when said water bottle is received in said storage chamber, wherein said holding bracket is adapted to have a curvature larger than a curvature of said water bottle, in such a manner that said holding bracket is capable of substantially retaining said water bottle in position to prevent a lateral movement of said water bottle in said storage chamber, wherein said holding bracket comprises a first yoke mounted at said opening of said storage chamber and a second yoke spaced apart from said first yoke so as to substantially increase a supporting surface of said holding bracket for supporting said water bottle;

a rear stopper arm spaced from and position below said holding bracket; and a guiding body inclinedly extended from said holding bracket to said stopper arm for guiding said water bottle to slide into said storage chamber until a bottom side of said water bottle is stopper at said stopper arm so as to inclinedly support said water bottle in said storage chamber.

2. A water dispenser stand, comprising:

a floor stand having a storage chamber and an opening communicating with said storage chamber and with the outside, wherein said floor stand comprises first, second and third supporting legs downwardly extending to define said storage chamber within said first, second, and third supporting legs, wherein said holding bracket is transversely extended between said first and second supporting legs while said stopper arm is affixed to said third supporting leg;

means for supporting a water bottle on top of said floor stand; and a storage arrangement, which is supported within said storage chamber of said floor stand, comprising:

a front holding bracket having an arc-shape and supported at said opening of said storage chamber for substantially retaining an upper portion of said water bottle when said water bottle is received in said storage chamber;

a rear stopper arm spaced from and position below said holding bracket; and a guiding body inclinedly extended from said holding bracket to said stopper arm for guiding said water bottle to slide into said storage chamber until a bottom side of said water bottle is stopper at said stopper arm so as to inclinedly support said water bottle in said storage chamber.

3. A water dispenser stand, comprising:

a floor stand having a storage chamber and an opening communicating with said storage chamber and with the outside, wherein said floor stand comprises first, second and third supporting legs downwardly extending to define said storage chamber within said first, second, and third supporting legs, wherein said holding bracket is transversely extended between said first and second supporting legs while said stopper arm is affixed to said third supporting leg;

means for supporting a water bottle on top of said floor stand; and a storage arrangement, which is supported within said storage chamber of said floor stand, comprising:

a front holding bracket having an arc-shaped and supported at said opening of said storage chamber for substantially retaining an upper portion of said water bottle when said water bottle is received in said storage chamber, wherein said holding bracket is adapted to have a curvature larger than a curvature of said water bottle, in such a manner that said holding bracket is capable of substantially retaining said water bottle in position to prevent a lateral movement of said water bottle in said storage chamber;

a rear stopper arm spaced from and position below said holding bracket; and a guiding body inclinedly extended from said holding bracket to said stopper arm for guiding said water bottle to slide into said storage chamber until a bottom side of said water bottle is stopper at said stopper arm so as to inclinedly support said water bottle in said storage chamber.

4. A water dispenser stand, comprising:

a floor stand having a storage chamber and an opening communicating with said storage chamber and with the outside, wherein said floor stand comprises first, second and third supporting legs downwardly extending to define said storage chamber within said first, second, and third supporting legs, wherein said holding bracket is transversely extended between said first and second supporting legs while said stopper arm is affixed to said third supporting leg;

means for supporting a water bottle on top of said floor stand; and a storage arrangement, which is supported within said storage chamber of said floor stand, comprising:

a front holding bracket having an arc-shaped and supported at said opening of said storage chamber for substantially retaining an upper portion of said water bottle when said water bottle is received in said storage chamber, wherein said holding bracket is adapted to have a curvature larger than a curvature of said water bottle, in such a manner that said holding bracket is capable of substantially retaining said water bottle in position to prevent a lateral movement of said water bottle in said storage chamber;

a rear stopper arm spaced from and position below said holding bracket, wherein said stopper arm has a biasing portion perpendicularly extended to said guiding body in such a manner that said biasing portion of said stopper arm is capable of substantially biasing against a bottom side of said water bottle while said guiding body is capable of rigidly supporting a circumferential side of said water bottle thereon; and a guiding body inclinedly extended from said holding bracket to said stopper arm for guiding said water bottle to slide into said storage chamber until a bottom side of said water bottle is stopper at said stopper arm so as to inclinedly support said water bottle in said storage chamber.

5. A water dispenser stand, comprising:

a floor stand having a storage chamber and an opening communicating with said storage chamber and with the outside, wherein said floor stand comprises first, second and third supporting legs downwardly extending to define said storage chamber within said first, second, and third supporting legs, wherein said holding bracket is transversely extended between said first and second supporting legs while said stopper arm is affixed to said third supporting leg;

means for supporting a water bottle on top of said floor stand; and a storage arrangement, which is supported within said storage chamber of said floor stand, comprising:

a front holding bracket having an arc-shaped and supported at said opening of said storage chamber for substantially retaining an upper portion of said water bottle when said water bottle is received in said storage chamber, wherein said holding bracket is adapted to have a curvature larger than a curvature of said water bottle, in such a manner that said holding bracket is capable of substantially retaining said water bottle in position to prevent a lateral movement of said water bottle in said storage chamber;

a rear stopper arm spaced from and position below said holding bracket, wherein said stopper arm has a biasing portion perpendicularly extended to said guiding body in such a manner that said biasing portion of said stopper arm is capable of substantially biasing against a bottom side of said water bottle while said guiding body is capable of rigidly supporting a circumferential side of said water bottle thereon; and a guild body inclinedly extended from said holding bracket to said stopper arm for guild said water bottle to slide into said storage chamber until a bottom side of said water battle is stopper at said stopper arm so as to inclinedly support said water bottle in said storage chamber, wherein said guiding body is integrally extended from said holding bracket to said stopper arm to form an integral member so as to enhance a strength of said storage arrangement.

* * * * *